US006802251B2

(12) United States Patent
Yamamoto et al.

(10) Patent No.: US 6,802,251 B2
(45) Date of Patent: Oct. 12, 2004

(54) DAMPENING WATER FEEDING METHOD FOR A PRINTING MACHINE, AND THE PRINTING MACHINE

(75) Inventors: Takaharu Yamamoto, Kyoto (JP); Kazuki Fukui, Kyoto (JP); Tuyoshi Okuda, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/418,143

(22) Filed: Apr. 18, 2003

(65) Prior Publication Data

US 2003/0217654 A1 Nov. 27, 2003

(30) Foreign Application Priority Data

May 21, 2002 (JP) ..... 2002-146695

(51) Int. Cl.[7] ..... B41F 7/24; B41F 31/00
(52) U.S. Cl. ..... 101/147; 101/350.1; 101/484
(58) Field of Search ..... 101/147, 148, 101/450.1, 451, 484, 350.1

(56) References Cited

U.S. PATENT DOCUMENTS

| | | | | |
|---|---|---|---|---|
| 5,050,994 A | | 9/1991 | Kipphan et al. | |
| 5,341,734 A | | 8/1994 | Jeschke et al. | |
| 5,546,861 A | * | 8/1996 | Loffler | 101/484 |
| 5,568,769 A | * | 10/1996 | Leuerer | 101/450.1 |
| 5,713,286 A | * | 2/1998 | Zorn | 101/450.1 |
| 5,791,249 A | * | 8/1998 | Quadracci | 101/450.1 |
| 2002/0043166 A1 | | 4/2002 | Okuda | |

FOREIGN PATENT DOCUMENTS

| | | |
|---|---|---|
| EP | 1 136 266 A | 9/2001 |
| JP | 2-108542 | 4/1990 |
| JP | 6-23939 | 2/1994 |
| JP | 2001-239651 | 9/2001 |
| JP | 2002-127373 | 5/2002 |

* cited by examiner

*Primary Examiner*—Stephen R. Funk
(74) *Attorney, Agent, or Firm*—McDermott Will & Emery LLP

(57) ABSTRACT

A color density measuring step is executed for measuring color densities of unprinted areas on prints. Then, a determining step is executed for determining from the color densities of the unprinted areas on the prints whether ink tinting has occurred. When the determining step determines that ink tinting has occurred, a dampening water adjusting step is executed for adjusting a dampening water feeding rate after feeding dampening water in an increased rate once. A variation in the ink feeding rate is prohibited for a predetermined waiting time after feeding dampening water in the increased rate once in the dampening water adjusting step.

9 Claims, 12 Drawing Sheets

(a)

(b)

DAMPENING WATER FEEDING METHOD FOR A PRINTING MACHINE, AND THE PRINTING MACHINE

BACKGROUND OF THE INVENTION

1. Field of the Invention

This invention relates to a dampening water feeding method for a printing machine that controls an ink feeding rate and a dampening water feeding rate by measuring the color density of prints produced, and to the printing machine to which this method is applicable.

2. Description of the Related Art

Such a printing machine includes ink feeders for adjusting the rates of feeding inks to ink rollers. Each ink feeder has a plurality of ink keys juxtaposed in a direction perpendicular to a direction for transporting printing paper in time of printing. The rate of feeding ink to the ink rollers is adjusted by varying the opening degree of each ink key. In this way, the rate of feeding ink ultimately to the printing plate is adjusted.

The printing machine further includes dampening water feeders for adjusting the rate of feeding dampening water to water rollers. Each dampening water feeder includes a water source having a water vessel for storing dampening water and a fountain roller rotatable by a motor, and water rollers for transferring dampening water from the fountain roller to the surface of the printing plate. Such a dampening water feeder can adjust the rate of feeding dampening water to the surface of the printing plate by varying the rotational frequency of the fountain roller.

The printing plate has regions called detecting patches or control strips formed in positions corresponding to the respective ink keys. The opening degree of each ink key and the rotational frequency of the water fountain roller are adjusted by measuring, with a densitometer, the color density of the corresponding detecting patch actually printed on printing paper.

During a printing operation of the printing machine, a phenomenon called ink slagging may occur due to some cause. This ink slagging is a phenomenon in which background scumming (ink tinting) appears on blank portions (unprinted areas) of printing paper due to a relative shortage of dampening water.

Heretofore, generally, a determination of such ink slagging relies on a visual confirmation by the operator observing the printing paper printed. For this reason, inappropriate prints due to ink slagging could be produced in large quantities.

SUMMARY OF THE INVENTION

The object of this invention, therefor, is to provide a dampening water feeding method for a printing machine, and a printing machine, capable of avoiding inappropriate prints by detecting ink tinting and adjusting a dampening water feeding rate.

The above object is fulfilled, according to this invention, by a dampening water feeding method for a printing machine that controls an ink feeding rate and a dampening water feeding rate by measuring, with a color density measuring device, color density of prints produced, the method comprising a color density measuring step for measuring color densities of unprinted areas on prints with the color density measuring device, a determining step for determining from the color densities obtained in the color density measuring step whether ink tinting has occurred, and a dampening water adjusting step for adjusting the dampening water feeding rate when the determining step determines that ink tinting has occurred.

The above dampening water feeding method for a printing machine, and the printing machine, adjust the dampening water feeding rate upon detection of ink tinting. Consequently, inappropriate prints noted hereinbefore may be avoided.

In a preferred embodiment, the dampening water adjusting step is executed to adjust the dampening water feeding rate after feeding dampening water in an increased rate once.

Preferably, a variation in the ink feeding rate is prohibited for a predetermined waiting time after feeding dampening water in the increased rate once in the dampening water adjusting step.

In another preferred embodiment, the color density measuring device includes an image pickup unit for picking up images of printed printing paper transported toward a discharge unit, the color density measuring step being executed to detect the color densities of the unprinted areas on the prints with the image pickup unit.

In a further aspect of this invention, a printing machine comprises a color density measuring device for measuring color densities of unprinted areas on prints, and a control device for determining from the color densities measured by the color density measuring device whether ink tinting has occurred, and adjusting a dampening water feeding rate when ink tinting is determined to have occurred.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
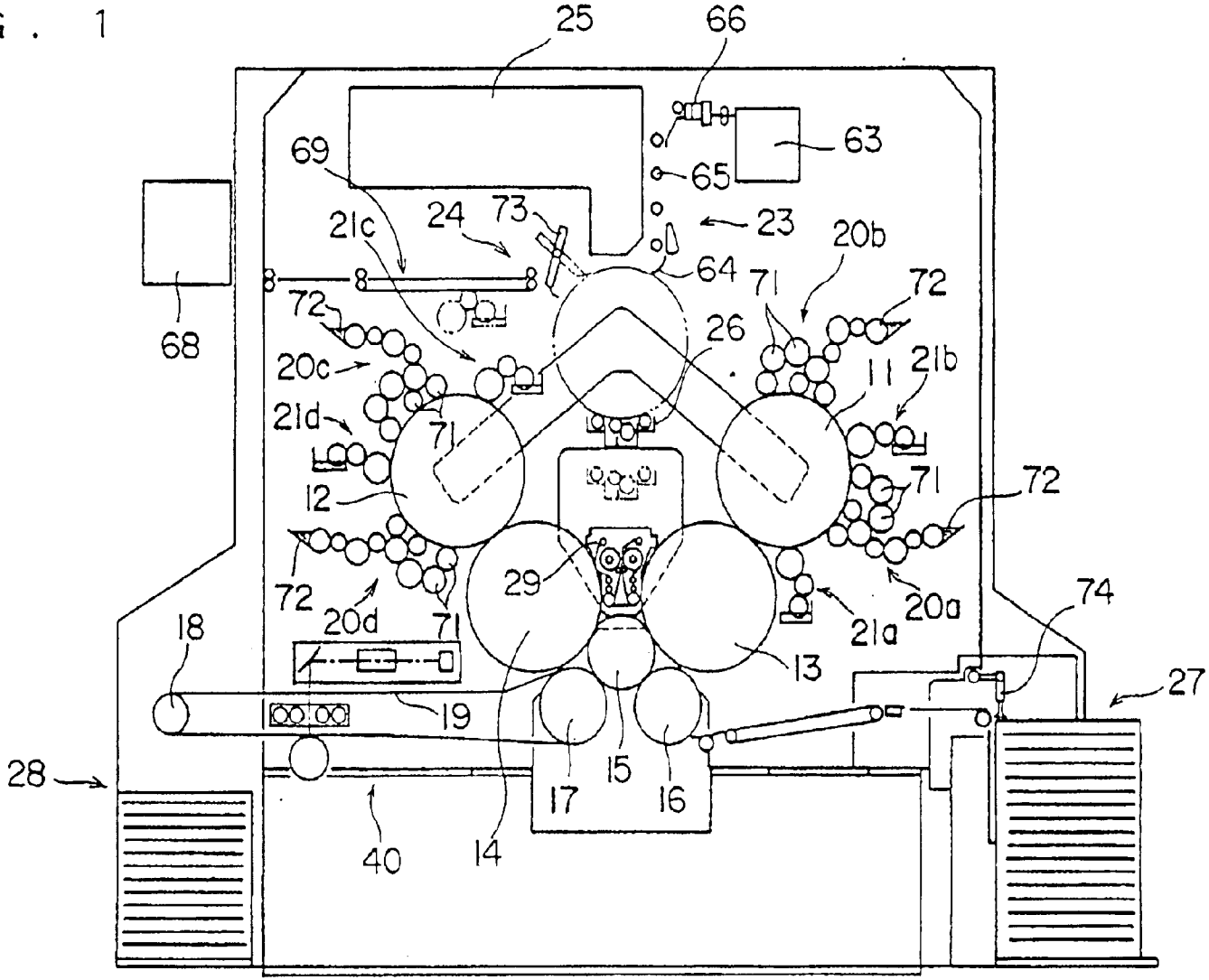
FIG. 1 is a schematic side view of a printing machine according to this invention.

An embodiment of the invention will be described hereinafter with reference to the drawings. FIG. 1 is a schematic side view of a printing machine according to the invention.

This printing machine records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring color densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, a discharge cassette 68, and a conveyor mechanism 69 for transporting the plate separated by the pawl mechanism 73 to the discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a laser beam, modulated based on image data, for recording images thereon.

Figure 2:
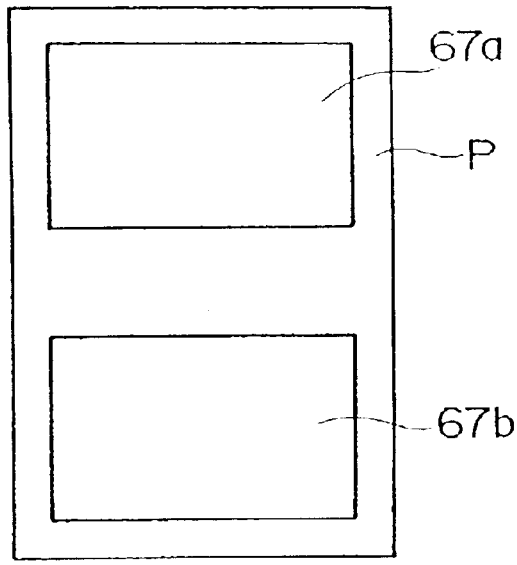
FIG. 2A is a plan view showing an arrangement of image areas, one for printing in black ink and the other for printing in magenta ink, on a printing plate mounted peripherally of a first plate cylinder.
FIG. 2B is a plan view showing an arrangement of image areas, one for printing in cyan ink and the other for printing in yellow ink, on a printing plate mounted peripherally of a second plate cylinder.
Figure 2:
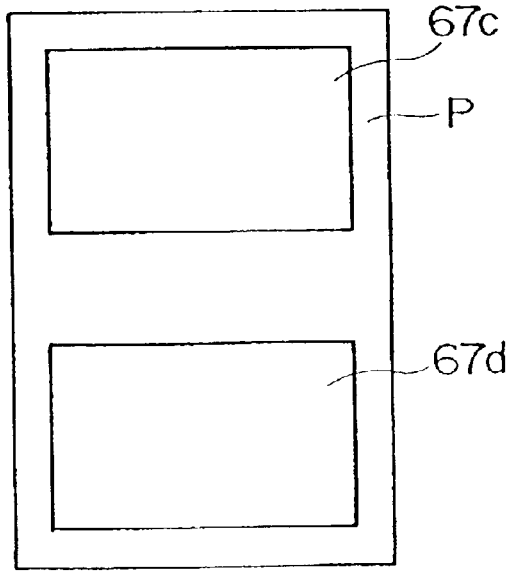

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
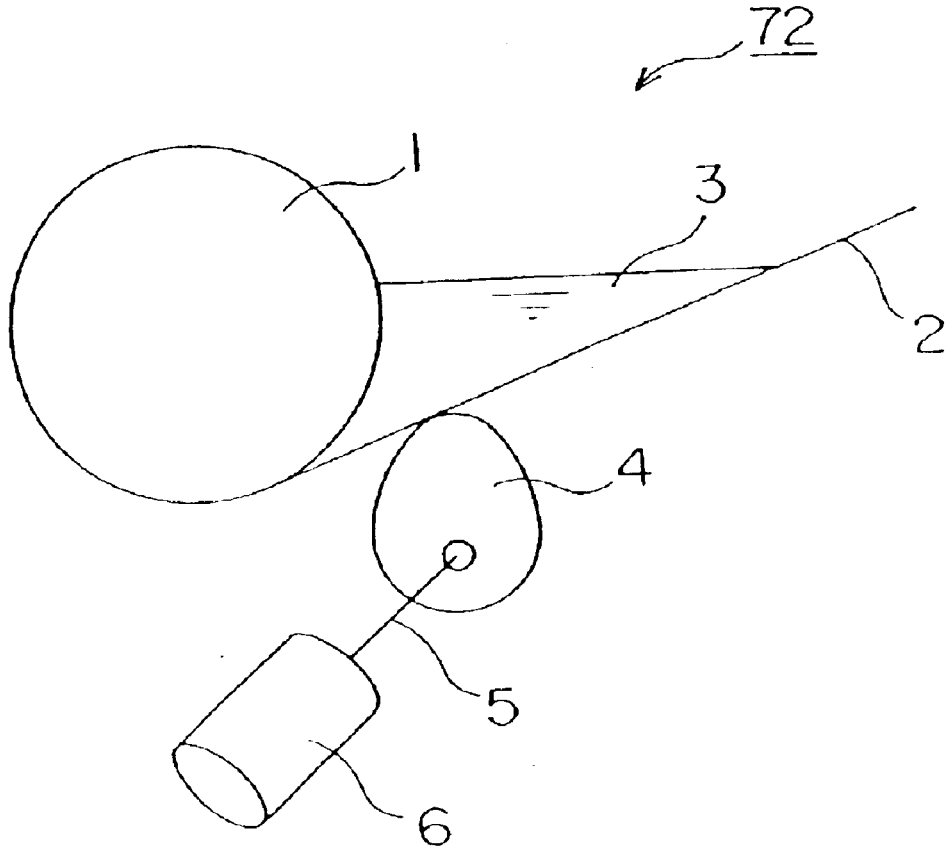
FIG. 3 is a schematic side view of an ink source.
Figure 4:
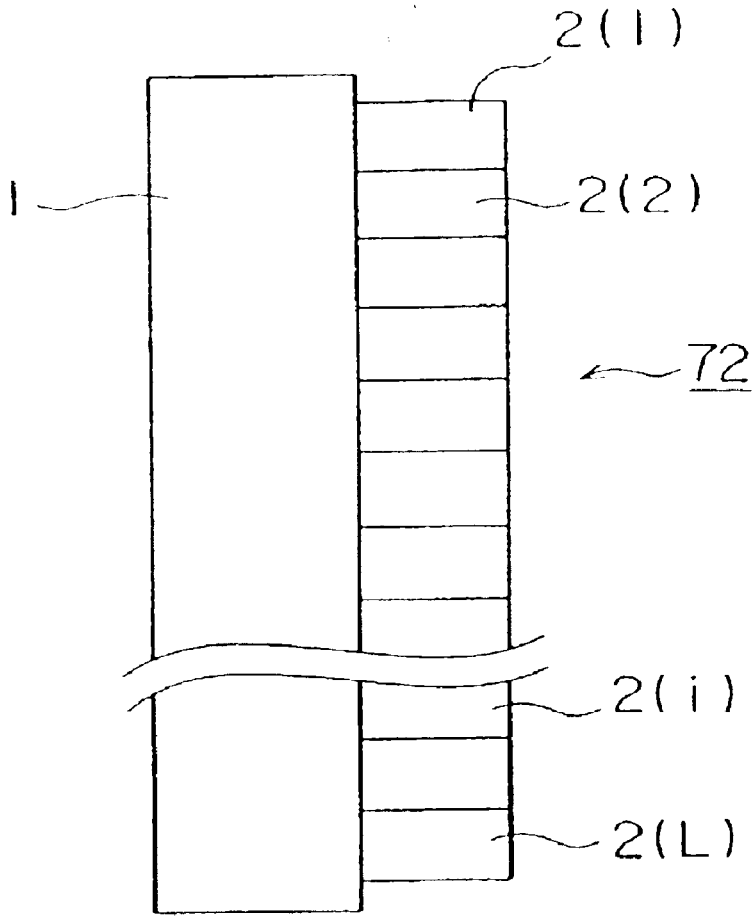
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the printing machine), and ink keys 2 (1), 2 (2). . . 2 (L) arranged in the direction of width of the printed matter. In this specification, these ink keys may be collectively called "ink keys 2". The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
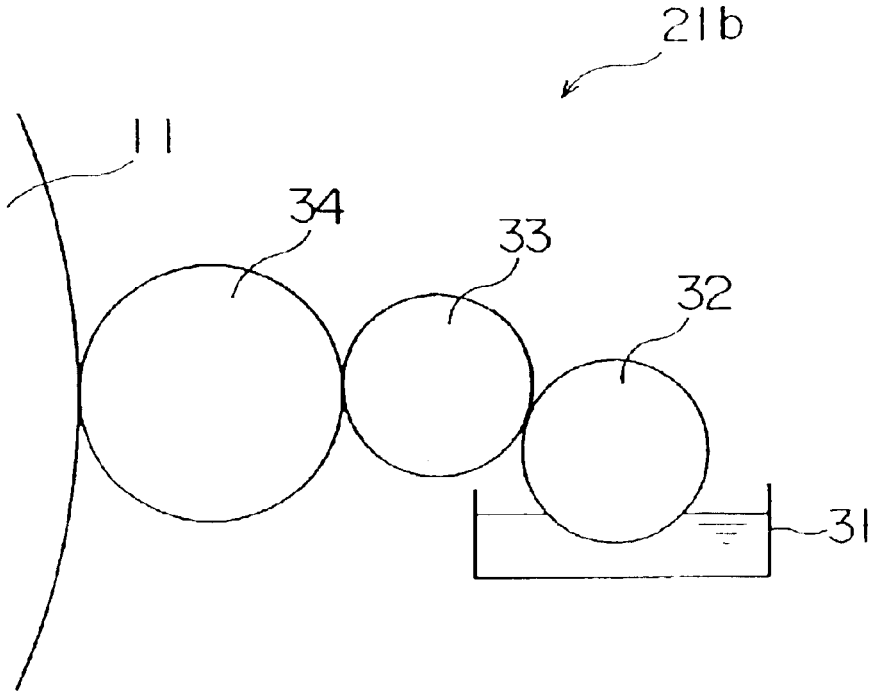
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, color densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
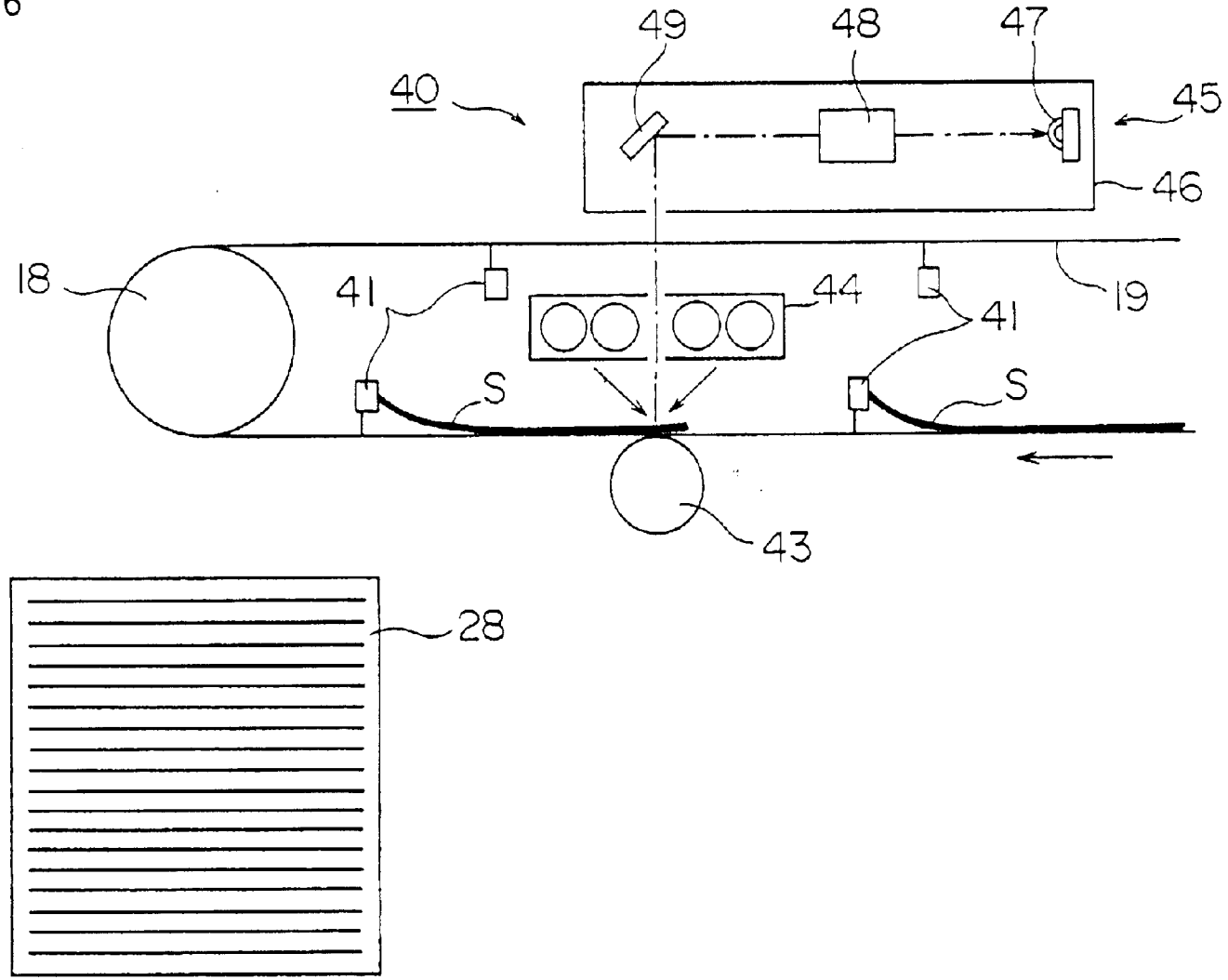
FIG. 6 is a schematic side view of an image pickup station shown with chains.

FIG. 6 is a schematic side view of the image pickup station 40 for measuring color densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 17. Thus, each gripper 41 receives printing paper S from the paper discharge cylinder 17, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs an operation, to be described hereinafter, of the image pickup station 40 to measure densities of the detecting patches. To avoid such an inconvenience, this printing machine provides a suction roller 43 disposed upstream of the paper discharge station 28 for stabilizing the printing paper S transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally.

The image pickup station 40 includes an illuminating unit 44 for illuminating the printing paper S transported, and an image pickup unit 45 for picking up images of the detecting patches on the printing paper S illuminated by the illuminating unit 44 and measuring color densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47.

Figure 7:
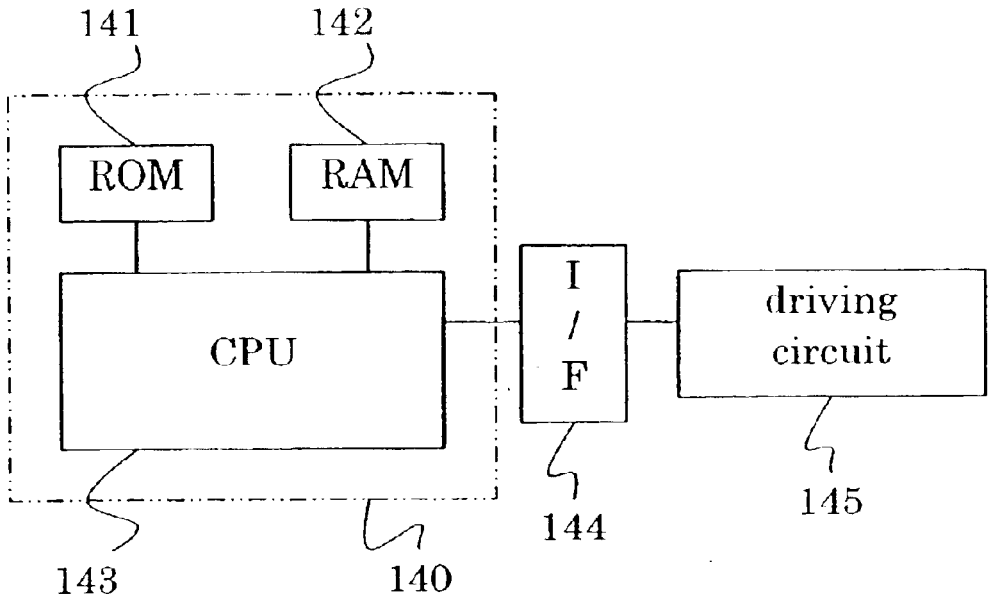
FIG. 7 is a block diagram of a principal electrical structure of the printing machine.

FIG. 7 is a block diagram showing a principal electrical structure of the printing machine. This printing machine includes a control unit 140 having a ROM 141 for storing operating programs necessary for controlling the machine, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorder 25, developing device 26, blanket cleaning unit 29, image pickup station 40, the contact mechanisms for the first and second blanket cylinders 13 and 14, and so on. The printing machine is controlled by the control unit 140 to execute prepress and printing operations as described hereinafter.

Figure 8:
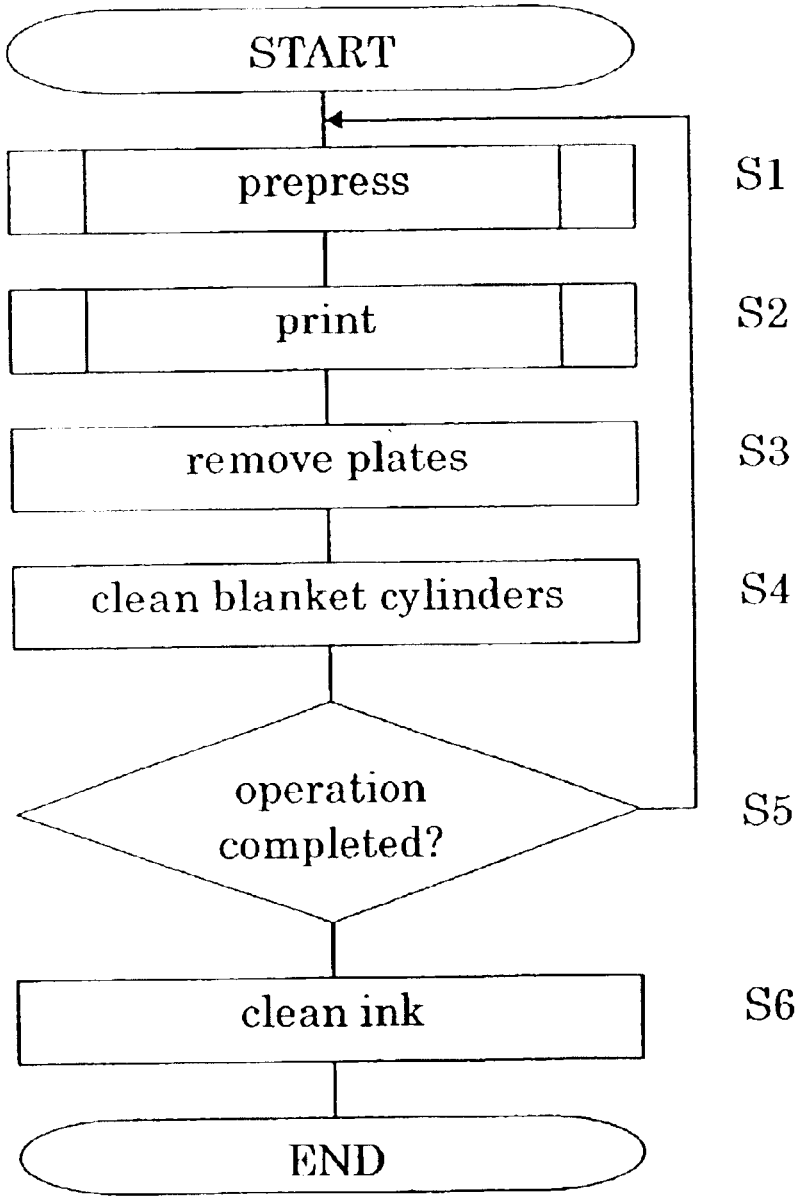
FIG. 8 is a flow chart of prepress and printing operations of the printing machine.

The prepress and printing operations of the printing machine will be described next. FIG. 8 is a flow chart showing an outline of the prepress and printing operations of the printing machine. These prepress and printing operations are directed to multicolor printing of printing paper S with the four color inks of yellow, magenta, cyan and black.

Figure 9:
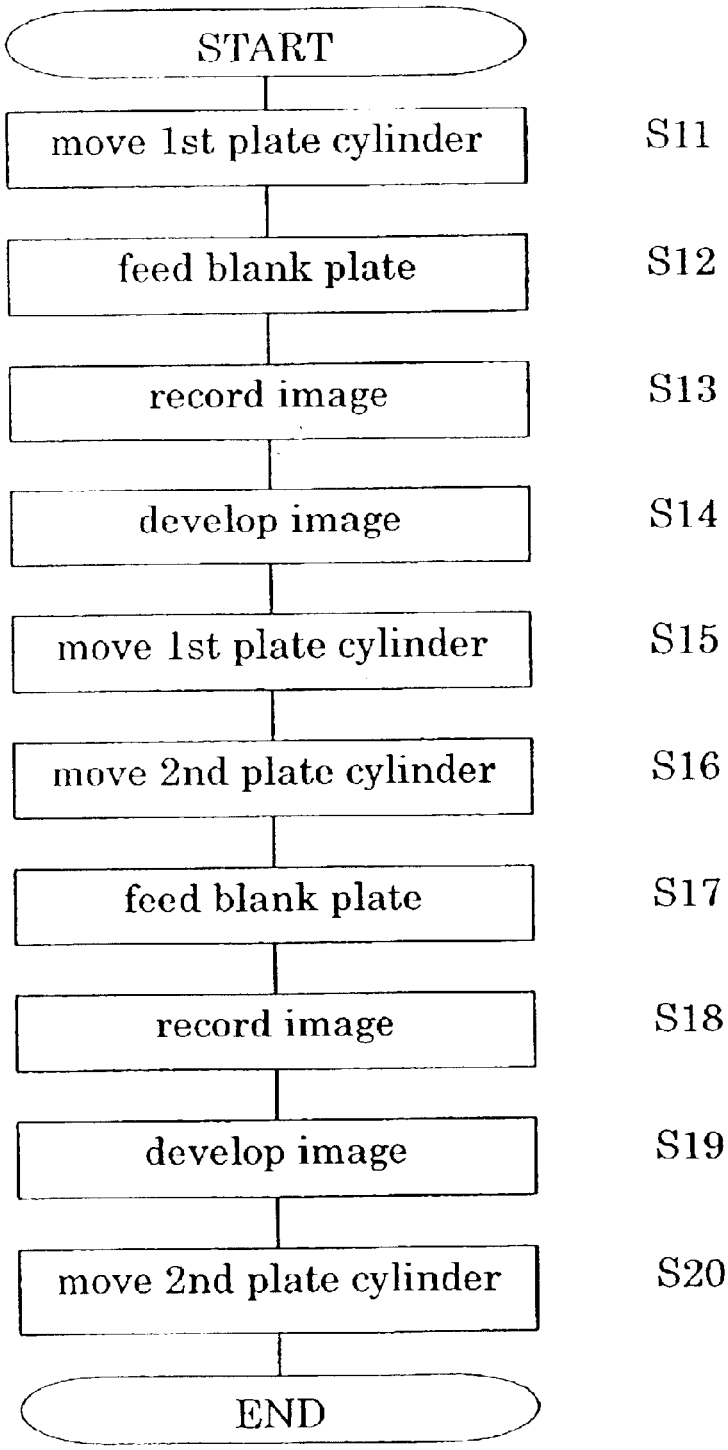
FIG. 9 is a flow chart of a prepress process.

First, the printing machine executes a prepress process for recording and developing images on the plates P mounted on the first and second plate cylinders 11 and 12 (step S1). This prepress process follows the steps constituting a subroutine as shown in the flow chart of FIG. 9.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of clamping jaws, not shown, clamp the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S1 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 8, the prepress process is followed by a printing process for printing the printing paper S with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper S wrapped around the impression cylinder 15 in its first rotation, and the magenta and yellow inks in its second rotation.

The forward end of the printing paper S printed in the four colors is passed from the impression cylinder 15 to the paper discharge cylinder 17. This printing paper S is transported by the pair of chains 19 toward the paper discharge station 28. After the color densities of the detecting patches are measured at the image pickup station 40, the printing paper S is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the blade mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing machine ends the entire process.

The printing machine having the above construction uses detecting patches also known as control scales to control the rates of feeding ink to the printing plates P.

Figure 10:
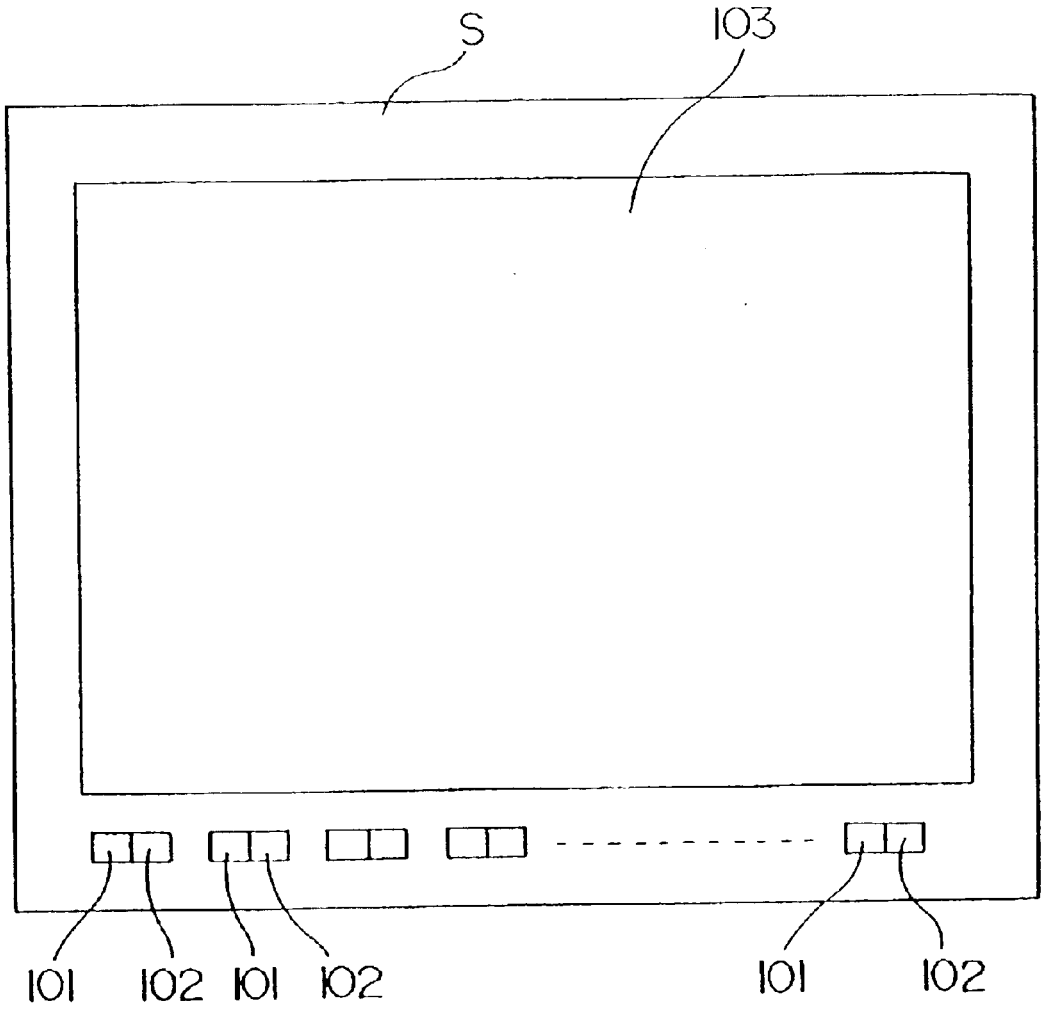
FIG. 10 is an explanatory view of first detecting patches and second detecting patches.

FIG. 10 is an explanatory view showing first detecting patches (first control strips) 101 and second detecting patches (second control strips) 102 printed on printing paper S after a printing process.

These first and second detecting patches 101 and 102 are printed in areas between one end of the printing paper S and an end of an image area 103 on the printing paper S. The first detecting patches 101 and second detecting patches 102 are arranged in discrete, adjacent pairs, L in number corresponding to the number L of areas divided in the direction of width of the printed matter (i.e. perpendicular to the printing direction of the printing machine), as are the ink keys 2 noted above. The material used for the first detecting patches 101 has a large halftone area ratio, or solid patches are used, while the material used for the second detecting patches 102 has a small halftone area ratio.

In the above printing machine, the color densities of the first and second detecting patches 101 and 102 are measured by the image pickup station 40. Based on the measured color densities of the first and second detecting patches 101 and 102, the pulse motors 6 are operated each for varying the opening degree of the ink key 2 shown in FIGS. 3 and 4, thereby to control the ink feeding rate. Further, based on the measured color densities of the first and second detecting patches 101 and 102, the rotational rate of each fountain roller 32 shown in FIG. 5 is varied to control the water feeding rate.

Furthermore, the image pickup station 40 measures densities of predetermined unprinted areas (blank portions of printing paper S) such as areas between the first and second detecting patches 101 and 102 and the image area 103 shown in FIG. 10, or areas around the first and second detecting patches 101 and 102 or around the image area 103. Presence or absence of ink tinting is determined from results of the measurement. When ink tinting is found, the dampening water feeding rate is adjusted to prevent ink tinting appearing on subsequent prints.

The control unit 140 designates beforehand such unprinted areas for density measurement by the image pickup station 40. Such unprinted areas may be designated by the operator inputting coordinate positions thereof by taking actually printed images into account.

The printing machine in this embodiment has the image recorder 25 for recording images on printing plates based on image data. Since unprinted areas of an image may be recognized based on the image data used in recording the image, positions of the unprinted areas for measurement by the color density measuring device may be determined from the image data. When an image is recorded on a positive type printing plate, areas of the printing plate not having the image recorded thereon may correspond to unprinted areas on prints. Thus, unprinted areas on the image data may be detected, and these areas may be designated as positions of unprinted areas.

In this printing machine, the image pickup station 40 automatically measures the densities of the first and second detecting patches 101 and 102. Thus, marginal portions spaced by a fixed distance from the first and second detecting patches 101 and 102 may be designated as unprinted areas. In this case, for example, unprinted areas may be set to areas above or below the first and second detecting patches 101 and 102, i.e. areas upstream or downstream thereof with respect to the printing direction. Such an approach is described in Japanese Unexamined Patent Publication No. 14-127373 (2002) also.

Figure 11:
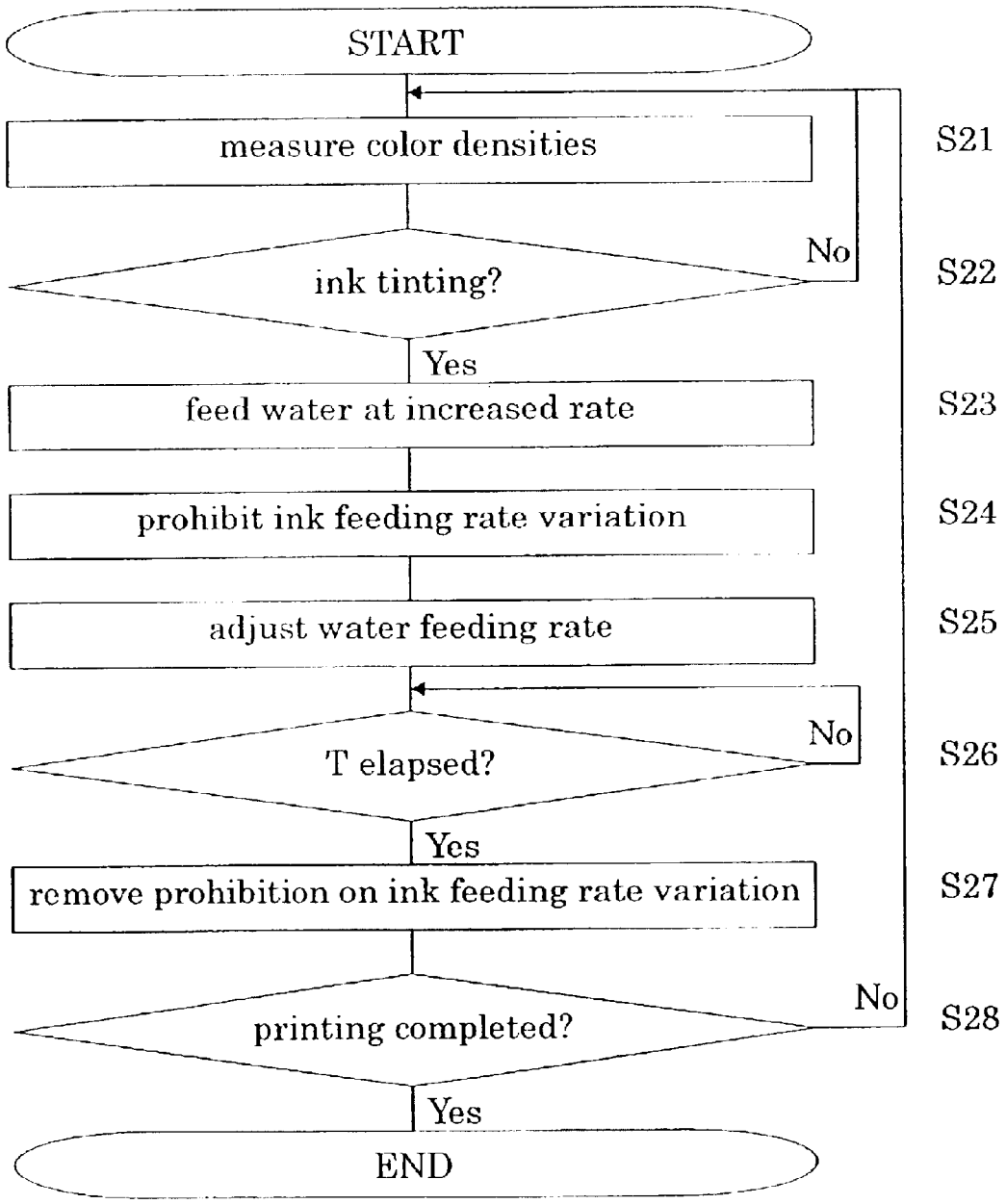
FIG. 11 is a flow chart of an operation of the printing machine for preventing ink tinting.
Figure 12:
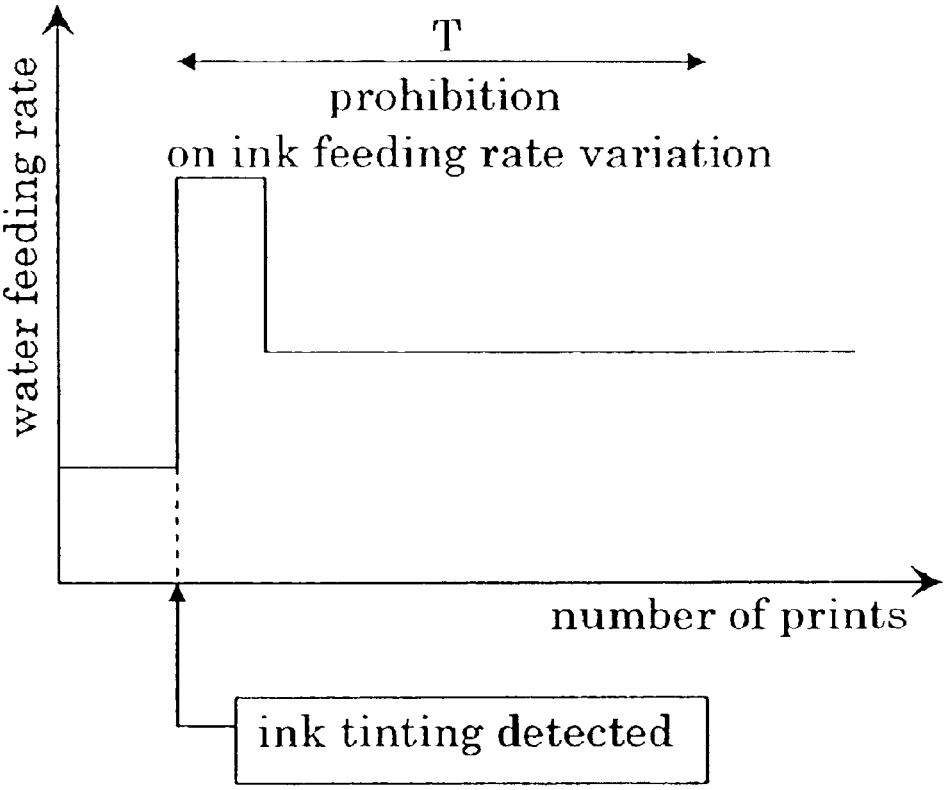
FIG. 12 is an explanatory view showing variations with time of a dampening water feeding rate.

An operation for preventing ink tinting will be described hereinafter. FIG. 11 is a flow chart showing an operation of the printing machine for preventing ink tinting. FIG. 12 is an explanatory view showing variations with time of the dampening water feeding rate resulting from this operation.

When performing the printing process (step S2) shown in FIG. 8, the image pickup station 40 shown in FIG. 6 measures the color densities of unprinted areas on the printing paper S along with the first and second detecting patches 101 and 102 printed on the printing paper S (step S21). The measurement of color densities may be performed for all printed sheets of printing papers S, or for every five printed sheets of printing paper S, for example.

Then, whether ink tinting has occurred or not is determined with respect to each of the yellow, magenta, cyan and black inks (step S22). In this determining step, the color densities of the unprinted areas measured by the image pickup station 40 are compared with normal values of color density established according to the type and the like of printing paper S, thereby to determine whether ink tinting is found in any of the unprinted areas of printing paper S.

Where the image pickup station 40 is the type for detecting the light of RGB, the measurements of RGB are converted into yellow, magenta, cyan and black. More particularly, a low detection value of R indicates that tinting of the cyan ink has occurred, a low detection value of G indicates tinting of the magenta ink, a low detection value of B indicates tinting of the yellow ink, and low detection values of all of RGB indicate tinting of the black ink.

Next, as shown in FIG. 12, the dampening water is forcibly fed in an increased rate for the ink causing tinting (step S23). This forced feeding of dampening water is effected by high-speed rotation of the fountain roller 32 shown in FIG. 5. The forced feeding of dampening water is completed within a time taken in printing about one sheet of printing paper S. This feeding time may be varied according to the level of ink tinting measured by the image pickup station 40.

In parallel with this, a variation in the rate of feeding ink from the ink source 72 shown in FIGS. 3 and 4 is prohibited (step S24). The prohibition on an ink feeding rate variation may be imposed only on the ink source 72 corresponding to the color ink causing the tinting.

However, in existing printing machines, the color inks used after the ink for which dampening water is fed forcibly may have their color densities lowered by the influence of the dampening water forcibly fed. In such a case, a prohibition may be imposed also on variations in the feeding rate of the other color inks, particularly of the color ink immediately following the ink in question. The color density of this immediately following ink is lowered by a relatively minor degree. Thus, a waiting time discussed hereinafter may be shorter for this ink than for the ink in question.

A variation in the ink feeding rate is prohibited for the following reasons. When dampening water is forcibly fed at an increased rate as noted above, the color density of a printed image temporarily falls off. Thus, where the ink feeding rate is automatically controlled, the ink keys 2 will be opened quickly to cause a considerable overshoot in the color density of an image printed after completion of the forced feeding of water. For this reason, a variation in the ink feeding rate is prohibited for a predetermined waiting time T after completion of the forced feeding of water. This waiting time T is set beforehand, according to the rate of forced feeding of dampening water, as a set number of sheets, e.g. approximately 30 sheets of printing paper S.

Upon completion of the forced feeding of dampening water, the dampening water feeding rate is adjusted (step S25). At this time, the dampening water feeding rate is adjusted to such a value that the ink tinting is eliminated, based on the color densities of the first and second detecting patches 101 and 102 and unprinted areas. As shown in FIG. 12, the dampening water feeding rate at this time is higher than what it was before the forced feeding of dampening water.

Upon lapse of the waiting time T after starting the forced feeding of dampening water (step S26), the prohibition on a variation in the ink feeding rate is removed (step S27). The above operation is repeated if further prints remain to be produced (step S28). The entire process is ended upon completion of the required printing.

The various operations described above are controlled by the control unit 140 shown in FIG. 7. The control unit 140 acts as a control device for determining from the color densities of unprinted areas on prints whether ink tinting has occurred, and for adjusting the dampening water feeding rate when ink tinting has been found.

In the foregoing embodiment, the invention is applied to the printing machine that performs a printing operation by recording images on blank printing plates mounted on the first and second plate cylinders 11 and 12, and transferring inks supplied to the printing plates through the first and second blanket cylinders 13 and 14 to printing paper held on the impression cylinder 15. However, this invention is applicable also to other, ordinary printing machines.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-146695 filed in the Japanese Patent Office on May 21, 2002, the entire disclosure of which is incorporated herein by reference.

What is claimed is:

1. A dampening water feeding method for a printing machine that controls an ink feeding rate and a dampening water feeding rate by measuring, with color density measuring means, color density of prints produced, said method comprising:

a color density measuring step for measuring color densities of unprinted areas on prints with said color density measuring means;

a determining step for determining from the color densities obtained in said color density measuring step whether ink tinting has occurred; and a dampening water adjusting step for adjusting the dampening water feeding rate when said determining step determines that ink tinting has occurred, wherein said dampening water adjusting step includes a step of forcibly feeding the dampening water with a temporarily increased rate, and thereafter a step of feeding the dampening water with a rate lower than the temporarily increased rate and higher than a rate prior to the step of forcibly feeding the dampening water.

2. A dampening water feeding method for a printing machine as defined in claim 1, wherein said color density measuring means includes an image pickup unit for picking up images of printed printing paper transported toward a discharge unit, said color density measuring step being executed to detect the color densities of the unprinted areas on the prints with said image pickup unit.

3. A dampening water feeding method for a printing machine as defined in claim 1, wherein a variation in the ink feeding rate is prohibited for a predetermined waiting time after feeding dampening water in the increased rate once in said dampening water adjusting step.

4. A printing machine comprising:

color density measuring means for measuring color densities of unprinted areas on prints;

dampening water feeding means for adjusting a dampening water feeding rate to be fed to a printing plate; and control means for determining from the color densities measured by said color density measuring means whether ink tinting has occurred, and adjusting a dampening water feeding rate by said dampening water feeding means when ink tinting is determined to have occurred, wherein said control means executes a step of forcibly feeding the dampening water with a temporarily increased rate, and thereafter a step of feeding the dampening water with a rate lower than the temporarily increased rate and higher than a rate prior to the step of forcibly feeding the dampening water.

5. A printing machine as defined in claim 4, wherein said color density measuring means includes an image pickup unit for picking up images of printed printing paper transported toward a discharge unit.

6. A printing machine as defined in claim 5, wherein said control means is arranged to prohibit a variation in the ink feeding rate for a predetermined waiting time after feeding dampening water in an increased rate once.

7. A printing machine as defined in claim 4, further comprising image recording means for recording images on printing plates based on image data, positions of said unprinted areas to be measured by said color density measuring means being set based on said image data.

8. A printing machine as defined in claim 7, wherein said control means is arranged to adjust the dampening water feeding rate after feeding dampening water in an increased rate once.

9. A printing machine as defined in claim 7, wherein said control means is arranged to prohibit a variation in the ink feeding rate for a predetermined waiting time after feeding dampening water in an increased rate once.

* * * * *